343-756 SR
9/2/80 OR 4,220,957

United States Patent [19]
Britt

[11] 4,220,957
[45] Sep. 2, 1980

[54] DUAL FREQUENCY HORN ANTENNA SYSTEM

[75] Inventor: Pope P. Britt, Marietta, Ga.

[73] Assignee: General Electric Company, Burlington, Vt.

[21] Appl. No.: 44,726

[22] Filed: Jun. 1, 1979

[51] Int. Cl.[2] ..... H01Q 19/00
[52] U.S. Cl. ..... 343/756; 343/755; 343/779; 343/872
[58] Field of Search ..... 343/753–756, 343/779, 781 C, 781 A, 781 R, 872, 837, 838

[56] References Cited

U.S. PATENT DOCUMENTS

| | | | |
|---|---|---|---|
| 2,736,895 | 2/1956 | Cochrane | 343/756 |
| 2,943,324 | 6/1960 | Sichak | 343/756 |
| 3,281,850 | 10/1966 | Hannan | 343/756 |
| 3,394,378 | 7/1968 | Williams et al. | 343/779 |
| 3,514,779 | 5/1970 | Commault | 343/756 |

FOREIGN PATENT DOCUMENTS

| | | |
|---|---|---|
| 777935 | 2/1968 | Canada . |
| 1512718 | 1/1978 | United Kingdom . |

*Primary Examiner*—David K. Moore
*Attorney, Agent, or Firm*—Bailin L. Kuch

[57] ABSTRACT

A feature of this invention is the provision of an antenna system providing two, coaxial, copolarized, independently focused beams: a relatively wide, low frequency, searching beam, and a relatively narrow, high frequency, tracking beam; and comprising a dual frequency, dual polarization feedhorn; a polarization dependent subreflector; a concave polarization reversing reflector; a concave polarization twisting reflector; and a planar frequency dependent dielectric lens.

8 Claims, 4 Drawing Figures

DUAL FREQUENCY HORN ANTENNA SYSTEM

BACKGROUND OF THE INVENTION

1. Field of the Invention

This invention relates to radar antennas, and particularly to an antenna system for a search and track radar system.

2. Prior Art

The potential tracking precision of a radar employing monopulse or other techniques becomes greater as the tracking beamwidth is reduced. However, the probability of acquisition of a target becomes greater as the searching beamwidth is increased. Thus it is desirable to have as wide a beamwidth as possible to acquire a target and as narrow a beamwidth as possible to angularly resolve and track a target. It is customary, therefore, to utilize both a wide and a narrow beam. It is also desirable to have both beams directed coaxially and with like polarization, and, under certain circumstances, to operate both beams simultaneously.

One known approach varies the geometry of the antenna components by mechanical means to increase the beamwidth of a basically narrow beam design, i.e., "beam-spoiling". Another approach switches electrical elements in the beam forming mechanism. Both approaches preclude simultaneous wide and narrow beam operation. Another approach utilizes orthogonal polarizations for the two frequencies, to allow simultaneous operation.

For a constant antenna aperture size, the beamwidth gets narrower as the frequency is increased. This fact has been utilized to solve the problem set forth above by either switched or simultaneous operation at low and high frequency bands. Prior approaches based on this concept have employed lens or reflecting systems in which the internal geometry of the antenna system is more or less common to both frequency bands. Such antennas are difficult to design and maintain because of interaction between the two frequency bands as adjustments are attempted.

Various approaches to these problems are shown in:

"Introduction To Radar Systems" by M. I. Skolnik, p. 286, McGraw-Hill Book Company 1962;

U.S. Pat. No. 2,736,895, issued Feb. 28, 1956, to C. A. Cochrane;

U.S. Pat. No. 2,943,324, issued June 28, 1960, to W. Sichak;

U.S. Pat. No. 3,281,850, issued Oct. 25, 1966, to P. W. Hannan;

U.S. Pat. No. 3,514,779, issued May 26, 1970, to Y. Commault;

Canadian Pat. No. 777,935, issued Feb. 6, 1968, to J. R. Mark; and

UK Pat. No. 1,512,718, issued Jan. 1, 1978, to C. F. Whitebread et al.

An object of this invention is to provide an antenna system enabling simultaneous wide band and narrow band operation.

Another object is to provide such a system with coaxial operation and to allow colinear polarization.

A feature of this invention is the provision of an antenna system providing two, coaxial, independently focused beams: a relatively wide, low frequency, searching beam, and a relatively narrow, high frequency, tracking beam; and comprising a dual frequency, dual polarization feedhorn; a polarization dependent subreflector; a concave polarization reversing reflector; a concave polarization twisting reflector; and a planar frequency dependent dielectric lens.

BRIEF DESCRIPTION OF THE DRAWING

These and other objects, advantages and features of this invention will be apparent from the following specification thereof taken in conjunction with the accompanying drawing in which.

DESCRIPTION OF THE PREFERRED EMBODIMENT

Figure 2:
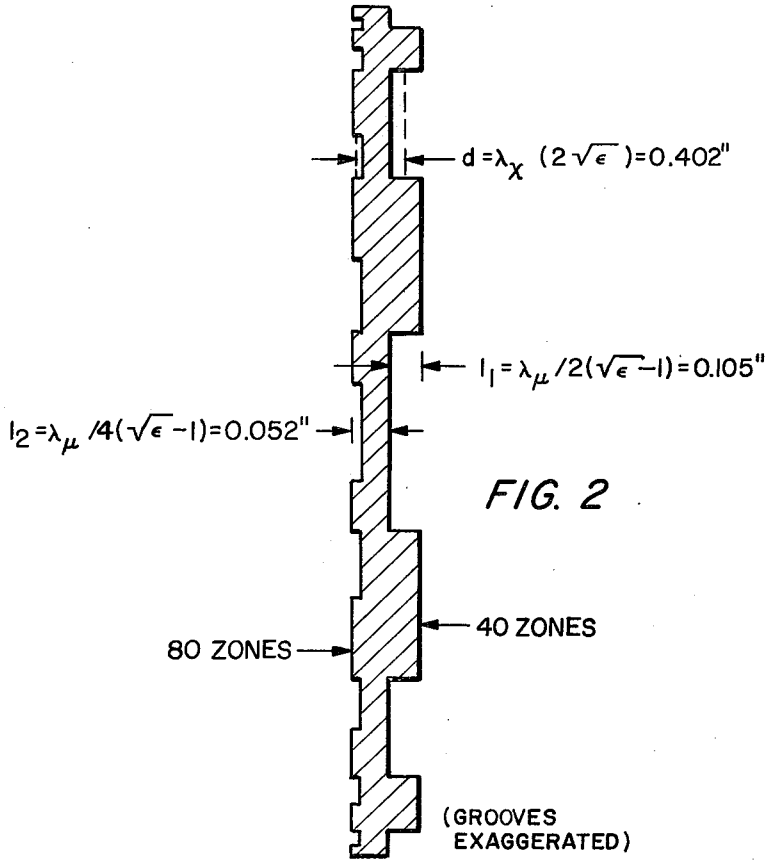
FIG. 2 is a cross-section of a two bit phase zone plate of the system of FIG. 1.
Figure 1:
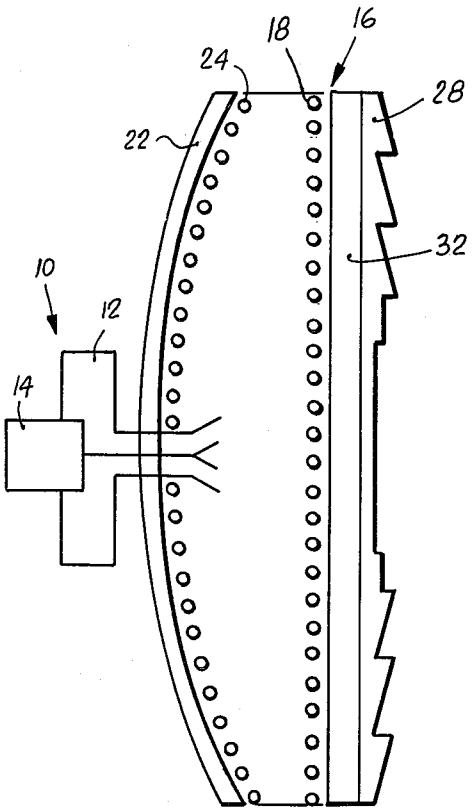
FIG. 1 is a schematic diagram of an antenna system embodying this invention.
Figure 4:
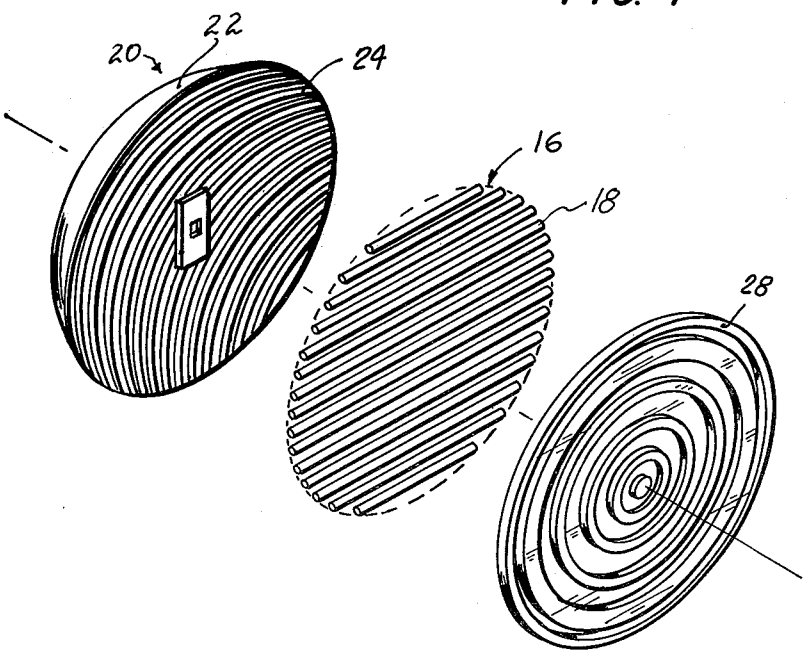
FIG. 4 is a partial isometric showing of the system of FIG. 1.
Figure 3:
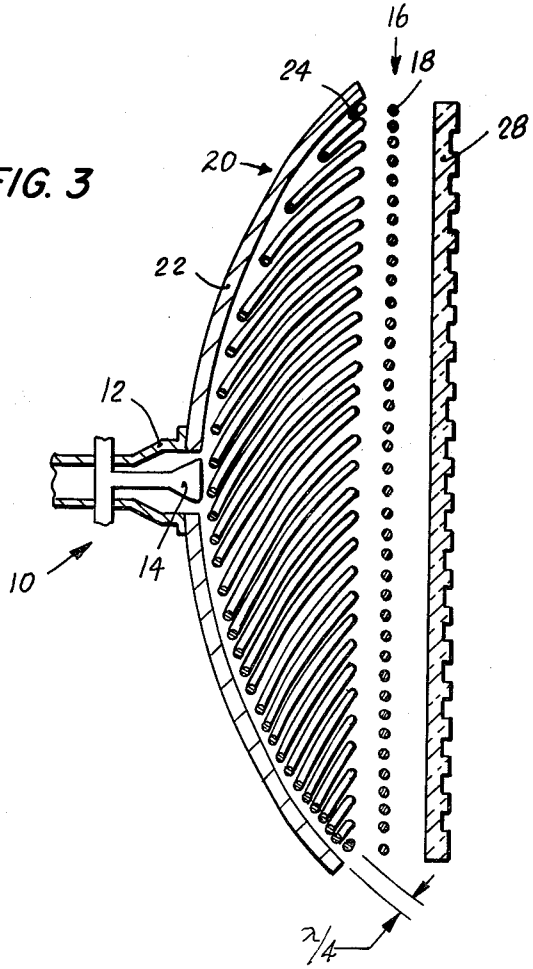
FIG. 3 is a longitudinal cross-section of the system of FIG. 1.

The dual frequency, dual polarization feedhorn 10 serves as a primary feed and includes, coaxially, a low frequency feedhorn 12, e.g., X-band (9.2 GHz) and a high frequency feedhorn 14, e.g., Millimeter Wavelength (94 GHz). The high and low frequency feeds are oriented such that their respective electric fields or polarization are 90° to each other. The X-band feed is horizontally polarized, the MMW feed is vertically polarized.

A front X-band subreflector 16 includes a flat grid of horizontal parallel wire conductors 18.

A rear X-band reflector 20 includes a parabolic reflector 22 with a grid of parallel wire conductors 24. The conductors are oriented at 45° to the conductors 18 of the front subreflector 16 and are spaced in front of the reflector 22 by $\frac{1}{4}$ wavelength (X-band). The reflector has an opening at its vertex to admit the primary feed 10. The reflector serves as a polarization twist parabola and in conjunction with the subreflector 16 serves as a Cassegrain antenna.

A zoned MMW lens 28 is mounted forward of the subreflector 16. It consists of a disk of Rexolite or similar dielectric with annular grooves 30 formed in it to focus the direct radiation from the MMW feedhorn 14. The lens 28 is designed to serve as a radome at X-band frequencies and as a Fresnel lens at MMW frequencies. The surface features that collimate the MMW phase front appear as only minor surface roughness at X-band, i.e., less than 10° r.m.s. phase error at 9.2 GHz.

The horizontally polarized wire grid 16 serving as the X-band subreflector has no effect on the vertically polarized MMW feed since the wire diameter, e.g., 0.010 inch, and spacing, e.g., 0.060 inch, are insignificant with respect to a wavelength at X-band, e.g., 0.125 inch at 94 GHz.

The lens 28 and the grid 16 may be provided with a low density foam spacer 32 to form a mechanically rigid structure.

An exemplary two surface Fresnel two bit phase zone plate to serve as the lens 28 at 94 GHz is shown in FIG. 2. A discussion of such lenses may be found in Skolnik, op. cit., at p. 286 et seq. This plate has the following advantages: The zones of radial width smaller than $\lambda/2$ are essentially smooth to a plane wave. The zone depth on each side acts as surface matching for a depth less than $\lambda/4$. Utilizing the second bit on the second surface decreases the surface interference depth and creates a B-sandwich which increases the bandwidth for the lower frequency. The Fresnel plate has an extra degree of freedom over a stepped lens which can be used to permit smaller F/D. The double frequency second bit cut on the back surface reduces the flat center spot which is larger than $\lambda/2$ at the lower frequency. The transmit mode of operation will be discussed. The reciprocity theorem of antenna theory applies for the receive mode. Both X-band and MMW operation occur simultaneously.

The X-band feed polarization from the feedhorn 12 and the subreflector grid wires 16 are all horizontal, so that energy incident on the flat subreflector 16 is reflected horizontally polarized to the main reflector 20. The parallel wires 24 in the main reflector overlay grid are aligned at 45°, therefore, one 45° component of the incident field is reflected directly from the grid, while the orthogonal component penetrates to the metal paraboloid 22, which upon reflection gives this component an additional 180° of relative phase shift. Reversing this one component only has the effect of rotating the polarization of the total reflected wavefront 90° into vertical polarization. The parabolic shape of the reflector collimates the wavefront, focusing the energy into a narrow beam. The horizontally polarized subreflector is transparent to this vertically polarized reflected energy, therefore, aperture blockage does not occur, except for the small hole occupied by the feedhorn.

The MMW feed from the feedhorn 14 is vertically polarized and the wire grid subreflector 16 is horizontally polarized, with wire size and spacing a small fraction of a wavelength at 94 GHz, so that MMW energy passes unobstructed to the dielectric lens 28. The lens is essentially a Fresnel zone plate which everywhere corrects the phase of the wavefront passing through it to be uniform. Quantizing the Fresnel zoned lens to two bits results in a flat, stepped lens that is simple to manufacture. The bandwidth of a two-foot diameter flat lens at 94 GHz will exceed 1 GHz, and the gain and sidelobe level will be significantly better than a conventional parabolic antenna.

What is claimed is:

1. An antenna system comprising:

a feedhorn system providing a first, relatively low frequency wavefront of energy which is polarized in a first direction, and a second, relatively high frequency wavefront of energy which is polarized in a second direction at 90° to said first direction;

a polarization dependent subreflector for said first frequency spaced forward of said feedhorn system;

a concave polarization twisting reflector for said first frequency spaced aft of said polarization dependent subreflector;

a concave polarization reversing reflector spaced aft of said concave polarization twisting reflector by $\frac{1}{4}$ wavelength of said first frequency; and a dielectric lens for said second frequency spaced forward of said polarization dependent subreflector.

2. A system according to claim 1 wherein:

said dielectric lens serves as a radome to said first frequency and as a collimator to said second frequency.

3. A system according to claim 2 wherein:

said lens is a Fresnel lens.

4. A system according to claim 2 wherein:

said lens is a flat stepped plate.

5. A system according to claim 1 wherein:

said polarization dependent subreflector passes said second frequency to said lens and reflects said first frequency.

6. A system according to claim 5 wherein:

said first frequency as reflected by said subreflector is again reflected in part at 90° by said concave polarization twisting reflector, and again reflected in remaining part at 180° by said concave polarization reversing reflector, whereby said total first frequency wavefront is again reflected with a 90° phase shift relative to said first frequency wavefront as provided by said feedhorn system.

7. A system according to claim 6 wherein:

said polarization dependent subreflector includes a grid of parallel conductors having a first orientation, and said concave polarization twisting reflector includes a grid of parallel conductors having a second orientation which is at 45° to said first orientation.

8. A system according to claim 1 wherein:

said first and second wavefronts of energy, as transmitted by said antenna system, are coaxial and colinear in polarization.

* * * * *